US006481835B2

(12) United States Patent
Hawkins et al.

(10) Patent No.: US 6,481,835 B2
(45) Date of Patent: Nov. 19, 2002

(54) CONTINUOUS INK-JET PRINTHEAD HAVING SERRATED GUTTER

(75) Inventors: Gilbert A. Hawkins, Mendon, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/771,540

(22) Filed: Jan. 29, 2001

(65) Prior Publication Data

US 2002/0101474 A1 Aug. 1, 2002

(51) Int. Cl.[7] ..... B41J 2/07
(52) U.S. Cl. ..... 347/77
(58) Field of Search ..... 347/90, 73, 77, 347/40, 41, 82

(56) References Cited

U.S. PATENT DOCUMENTS

| | | | | |
|---|---|---|---|---|
| 3,560,641 A | | 2/1971 | Taylor et al. | 358/296 |
| 3,701,998 A | | 10/1972 | Mathis | |
| 4,010,477 A | | 3/1977 | Frey | 347/74 |
| 4,031,563 A | | 6/1977 | Paranjpe et al. | 347/77 |
| 4,194,210 A | * | 3/1980 | Krause | 347/77 |
| 4,223,320 A | | 9/1980 | Paranjpe et al. | 327/76 |
| 4,809,016 A | * | 2/1989 | Padalino | 347/41 |
| 6,079,821 A | | 6/2000 | Chwalek et al. | |

FOREIGN PATENT DOCUMENTS

GB 1568551 5/1980

OTHER PUBLICATIONS

M.J. Brady, L. Kuhn, R. Lane and D. Sippel, "Self–Purging Deflector–Gutter for Ink Jet Arrays", IBM Technical Disclosure Bulletin, vol. 18, No. 4, Sep. 1975, p. 1236.*

* cited by examiner

*Primary Examiner*—Anh T. N. Vo
(74) *Attorney, Agent, or Firm*—Walter R. Zimmerli

(57) ABSTRACT

A continuous ink jet printhead is provided. The printhead includes a source of ink drops, a first nozzle row, and a second nozzle row displaced in a first direction and a second direction relative to the first nozzle row. A selection device is positioned relative to the first and second nozzle rows. The selection device is configured to direct ink drops ejected from the source through the first nozzle row along a first selected ink drop path and a first non-selected ink drop path. The selection device is also configured to direct ink drops ejected from the source through the second nozzle row along a second selected ink drop path and a second non-selected ink drop path. A gutter is positioned adjacent the first and second non-selected ink drop paths. The gutter is shaped to collect ink drops traveling along the first and second non-selected ink drop paths. The gutter includes a housing defining an ink removal channel. The housing has an edge with a second portion of the edge being displaced in the first direction and the second direction relative to a first portion of the edge such that displacement of the second edge portion corresponds to the displacement of the second nozzle row.

21 Claims, 7 Drawing Sheets

CONTINUOUS INK-JET PRINTHEAD HAVING SERRATED GUTTER

FIELD OF THE INVENTION

This invention relates generally to the design and fabrication of inkjet printheads and/or gutters, and in particular to the configuration of the inkjet gutters configured to collect ink drops from two dimensional nozzle arrays.

BACKGROUND OF THE INVENTION

Traditionally, digitally controlled inkjet printing capability is accomplished by one of two technologies. Both technologies feed ink through channels formed in a printhead. Each channel includes a nozzle from which droplets of ink are selectively extruded and deposited upon a medium.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of When a print is desired, the ink droplets are not deflected and allowed to strike a print media. Alternatively, deflected ink droplets may be allowed to strike the print media, while non-deflected ink droplets are collected in the ink capturing mechanism.

Regardless of the type of inkjet printer technology, it is desirable in the fabrication of inkjet printheads to space nozzles in a two-dimensional array rather than in a linear array. Printheads so fabricated have advantages in the areas relating to system performance and manufacturability. These advantages have been realized in currently manufactured drop-on-demand devices. For example, commercially available drop-on-demand printheads have nozzles which are disposed in a two-dimensional array in order to increase the apparent linear density of printed drops and to increase the space available for the construction of the ink drop firing chamber of each nozzle.

Additionally, commercially available piezoelectric drop-on-demand printheads have a two-dimensional array with nozzles arranged in a plurality of linear rows with each row displaced in a direction perpendicular to the direction of the rows. This nozzle configuration is used advantageously to decouple interactions between nozzles by preventing acoustic waves produced by the firing of one nozzle from interfering with the droplets fired from a second, neighboring nozzle. Neighboring nozzles are fired at different times to compensate for their displacement in a direction perpendicular to the nozzle rows as the printhead is scanned in a fast scan direction.

Attempts have also been made to provide redundancy in drop-on-demand printheads to protect the printing process from failure of a particular nozzle. In these attempts, two rows of nozzles were located aligned in a first direction, but displaced from one another in a second direction. The second direction being perpendicular to the first direction. There being no offset between the nozzle rows in the first direction, a printed drop origination from the first row could be printed redundantly from a nozzle positioned in the second row.

However, for continuous inkjet printheads, two dimensional nozzle configurations have not been generally practiced successfully. This is especially true for printheads having a single gutter.

Typically, conventional continuous inkjet printheads use only one gutter for cost and simplicity reasons. Occasionally, all ejected ink drops need to be guttered, therefore, a single gutter is typically used to reduce component cost and simplify printing systems. As conventional gutters are made with a straight edge designed to capture drops from a linear row of nozzles, the gutter edge in prior art devices extends in a first direction which is in the direction of the linear row of nozzles. As such, traditionally, it has been viewed as impractical to locate nozzles displaced in a second direction, substantially perpendicular from the first direction, because it is difficult to steer or deflect drops from nozzles so located into the gutter. This is because the ability to steer or deflect drops has typically been limited to steering or deflecting of less than a few degrees. As such, the maximum displacement of a nozzle in the second direction is so limited that to date it has been impractical to implement.

A continuous inkjet gutter configured to collect ink drops from two dimensional nozzle arrays would be a welcome advancement in the art. Additionally, a continuous inkjet printhead having two dimensional nozzle arrays and a gutter configured to collect ink drops from the two dimensional nozzle arrays would also be a welcome advancement in the art.

SUMMARY OF THE INVENTION

An object of the present invention is to provide an inkjet gutter configured to collect ink drops from two dimensional nozzle arrays.

Another object of the present invention to provide a continuous inkjet printhead having two dimensional nozzle arrays.

Another object of the present invention is to provide a continuous inkjet printhead having a gutter configured to collect ink drops from two dimensional nozzle arrays.

It is yet another object of the present invention to provide a continuous inkjet printhead that simultaneously prints ink drops on a receiver at locations displaced from other printed ink drops.

It is yet another object of the present invention to provide a continuous inkjet printhead and printer that increases the density of printed pixels.

According to a feature of the present invention, a continuous ink jet printhead includes a source of ink drops; a first nozzle row, and a second nozzle row displaced in a first direction and a second direction relative to the first nozzle row. A selection device is positioned relative to the first and second nozzle rows. The selection device is configured to direct ink drops ejected from the source through the first nozzle row along a first selected ink drop path and a first non-selected ink drop path. The selection device is also configured to direct ink drops ejected from the source through the second nozzle row along a second selected ink drop path and a second non-selected ink drop path. A gutter is positioned adjacent to the first and second non-selected ink drop paths and is shaped to collect ink drops traveling along the first and second non-selected ink drop paths.

According to another feature of the present invention, the gutter includes a housing defining an ink removal channel. The housing has an edge with a second portion of the edge being displaced in the first direction and the second direction relative to a first portion of the edge such that displacement of the second edge portion corresponds to the displacement of the second nozzle row. Portions of the housing also define an opening extending along the edge.

According to another feature of the present invention, a gutter for a continuous ink jet printhead having a first nozzle row and a second nozzle row with the second nozzle row being displaced in a first direction and a second direction relative to the first nozzle row, includes a housing defining an ink removal channel. The housing has an edge with a second portion of the edge being displaced in the first direction and the second direction relative to a first portion of the edge such that displacement of the second edge portion corresponds to the displacement of the second nozzle row.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
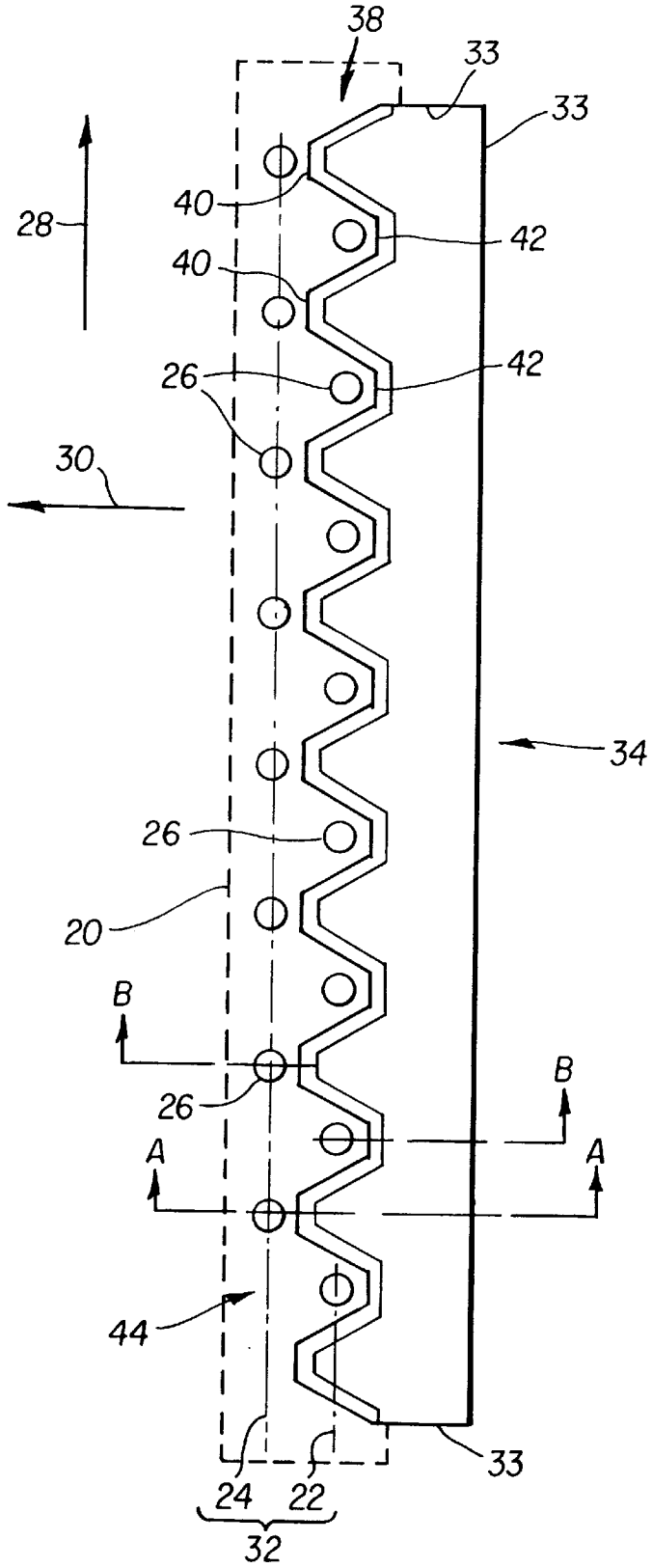
FIG. 1*a* is a schematic top view of an inkjet printhead showing the positioning relationship of a two dimensional nozzle array and a serrated gutter.

Referring to FIG. 1*a*, a schematic top view of a printhead 20 is shown. Although printhead 20 is illustrated schematically and not to scale for the sake of clarity, one of ordinary skill in the art will be able to readily determine the specific size and interconnections of the elements of the preferred embodiment. Printhead 20 includes at least two rows 22, 24 of nozzles 26. Row 22 extends in a first direction 28, while row 24 extends in first direction 28 displaced from row 22 in a second direction 30. Typically, second direction 30 is substantially perpendicular to first direction 28. Row 24 is also offset in first direction 28 from row 22 with nozzles 26 of row 24 being positioned in between nozzles 26 of row 22. Rows 22, 24 form a two dimensional nozzle array 32. A gutter 34 is positioned adjacent nozzle array 32 in second direction 30 and displaced from nozzle array 32 in a third direction 36 (shown in FIG. 1*b*) substantially orthogonal to directions 28 and 30. Gutter 34 includes a housing 33, defining an ink removal channel 82 (shown in FIG. 2*b*). An edge 38 of gutter 34 is non-uniform with gutter portions 40 being displaced or extended in second direction 30 relative to gutter portions 42 such that gutter portions 40 of edge 38 capture drops from nozzle row 24 (displaced in second direction 30 relative to nozzle row 22) and gutter portions 42 of edge 38 capture drops from nozzle row 22. As viewed in FIG. 1*a*, gutter portions 40 and 42 form a serrated profile 44.

Figure 1B:
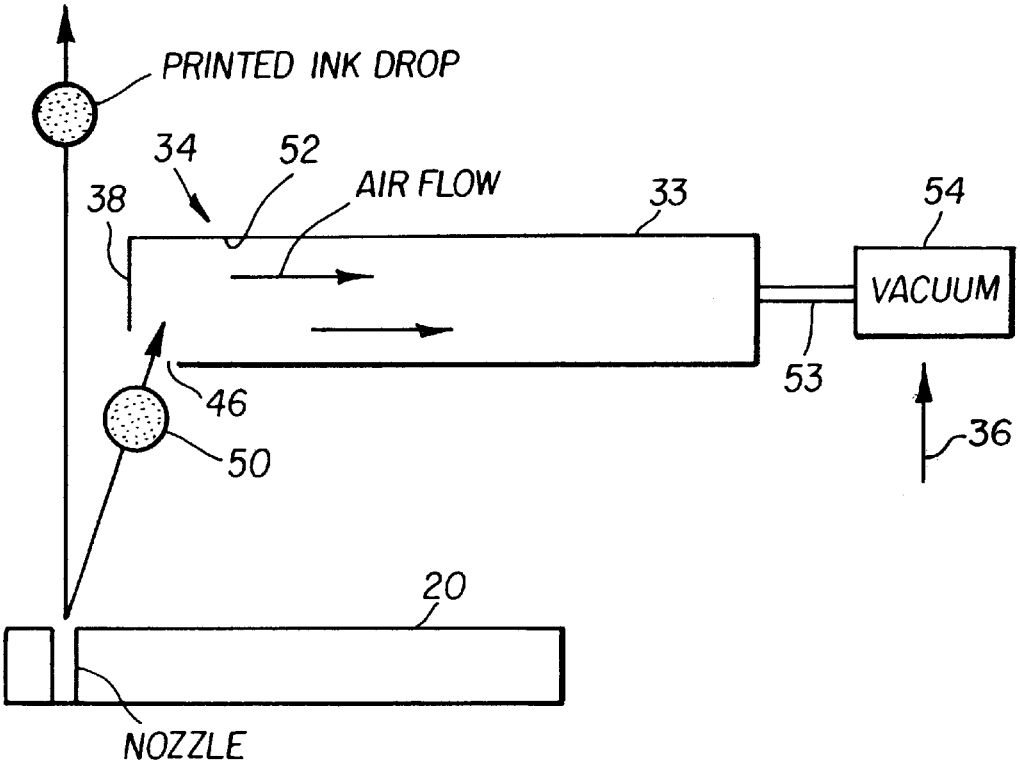
FIG. 1*b* is a schematic side view taken along line AA in FIG. 1*a;*

Referring to FIG. 1*b*, a schematic cross-sectional view taken along line AA in FIG. 1*a* is shown. Gutter 34 has an opening 46 along edge 38 that allows guttered drops 50 (non-selected ink drops) to enter gutter 34 and impinge on a gutter surface 52. Guttered drops 50 can then be recycled for subsequent use or disposed of through ink removal channel 53. A negative pressure source or vacuum 54 can be included to assist with this process, as is typically practiced in continuous ink jet printing.

Figure 1C:
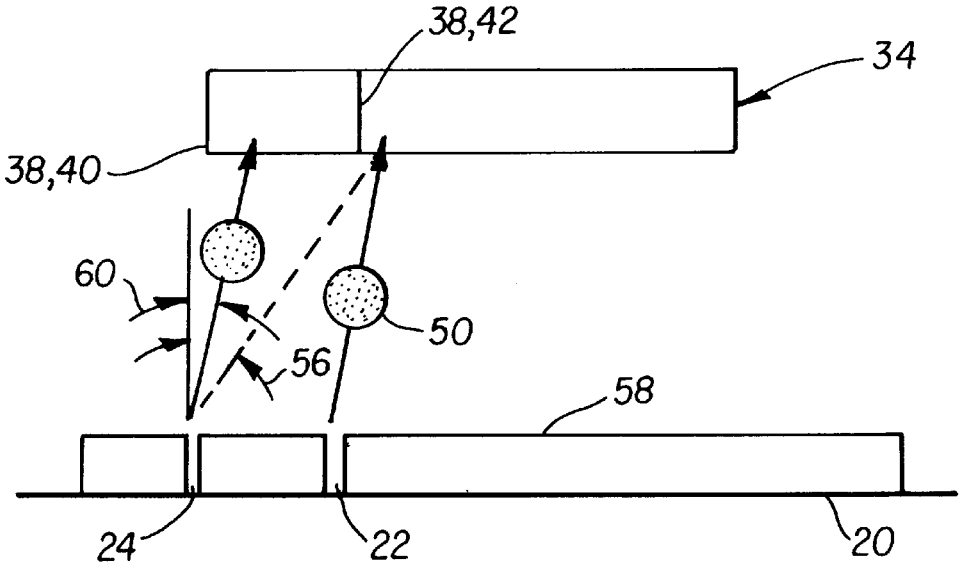
FIG. 1*c* is a schematic side view taken along line BB in FIG. 1*a;*

Referring to FIG. 1*c*, a schematic cross-sectional view taken along line BB in FIG. 1*a* is shown. Ink drops from nozzle row 22 are captured by gutter portion 42 while ink drops from nozzle row 24 are captured in gutter portion 40. FIG. 1*c* also shows that if extended gutter portion 40 were not displaced in second direction 30, ink drops from nozzle row 24 would have to be deflected through a large deflection angle 56 in order to be guttered. For example, if nozzle row 24 is displaced 5 mm from nozzle row 22, and a straight edged gutter is located 5 mm from surface 58 of printhead 20, large deflection angle 56 is required to be approximately 45 degrees. However, using gutter 34, a deflection angle 60 of about 2 degrees is required for ink drops from row 24 to be captured by gutter portion 40.

Figure 1D:
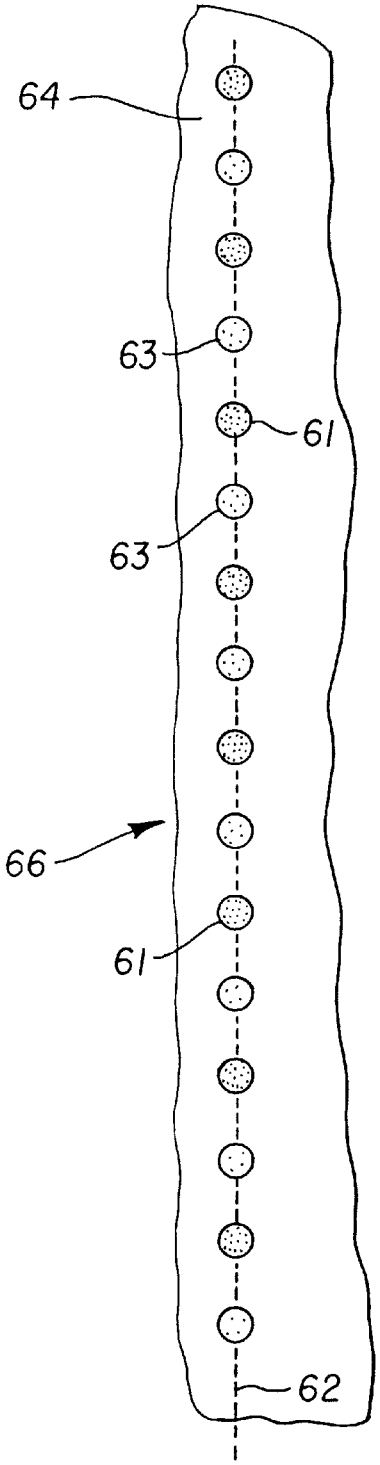
FIG. 1*d* is a schematic view of smaller printed droplets from a continuous inkjet printhead having the two dimensional array of nozzles and serrated gutter of FIG. 1*a;*
Figure 1E:
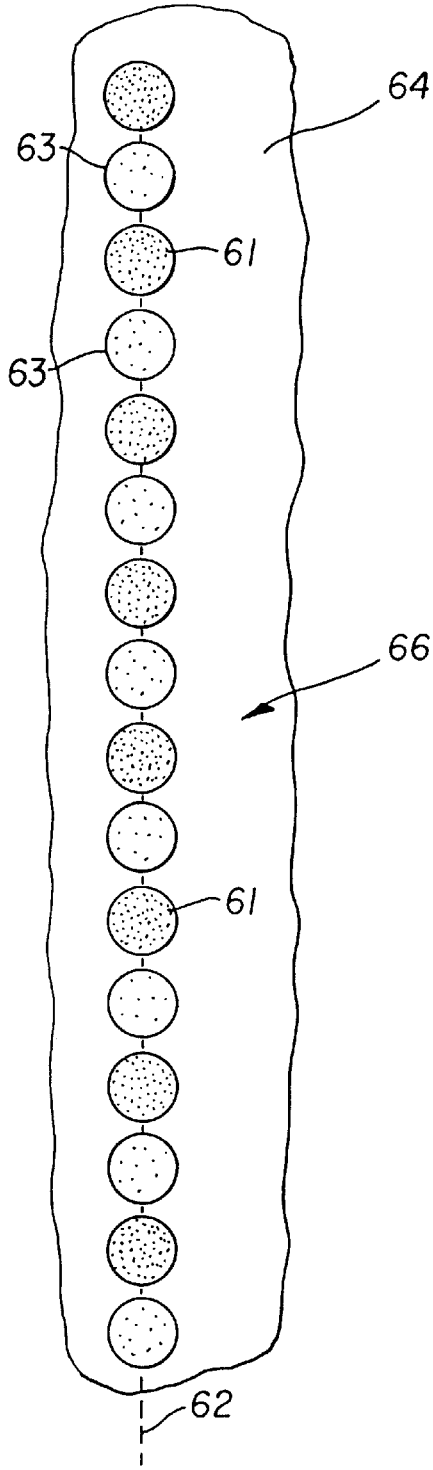
FIG. 1*e* is a schematic view of larger printed droplets from a continuous inkjet printhead having the two dimensional array of nozzles and serrated gutter of FIG. 1*a;*

Referring to FIGS. 1*d* and 1*e*, a representative print line 62 on a receiver 64 is shown. By appropriately timing the firing of nozzle rows 22 and 24, such that ink drops 61 from the nozzle row 24 land on the same print line 62 on receiver 64 as ink drops 63 from nozzle row 22, a row of printed drops 66 is formed. In FIG. 1*d*, ink drop sizes are smaller as compared to ink drop sizes in FIG. 1*e*. Ink drop size can be controlled by the frequency of activation of a selection device 72 by a controller 84, discussed below in reference to FIGS. 2*a* and 2*b*. Alternatively, ink drop size can be controlled by the size of nozzles 26, shown in FIG. 1*a*.

Figure 1F:
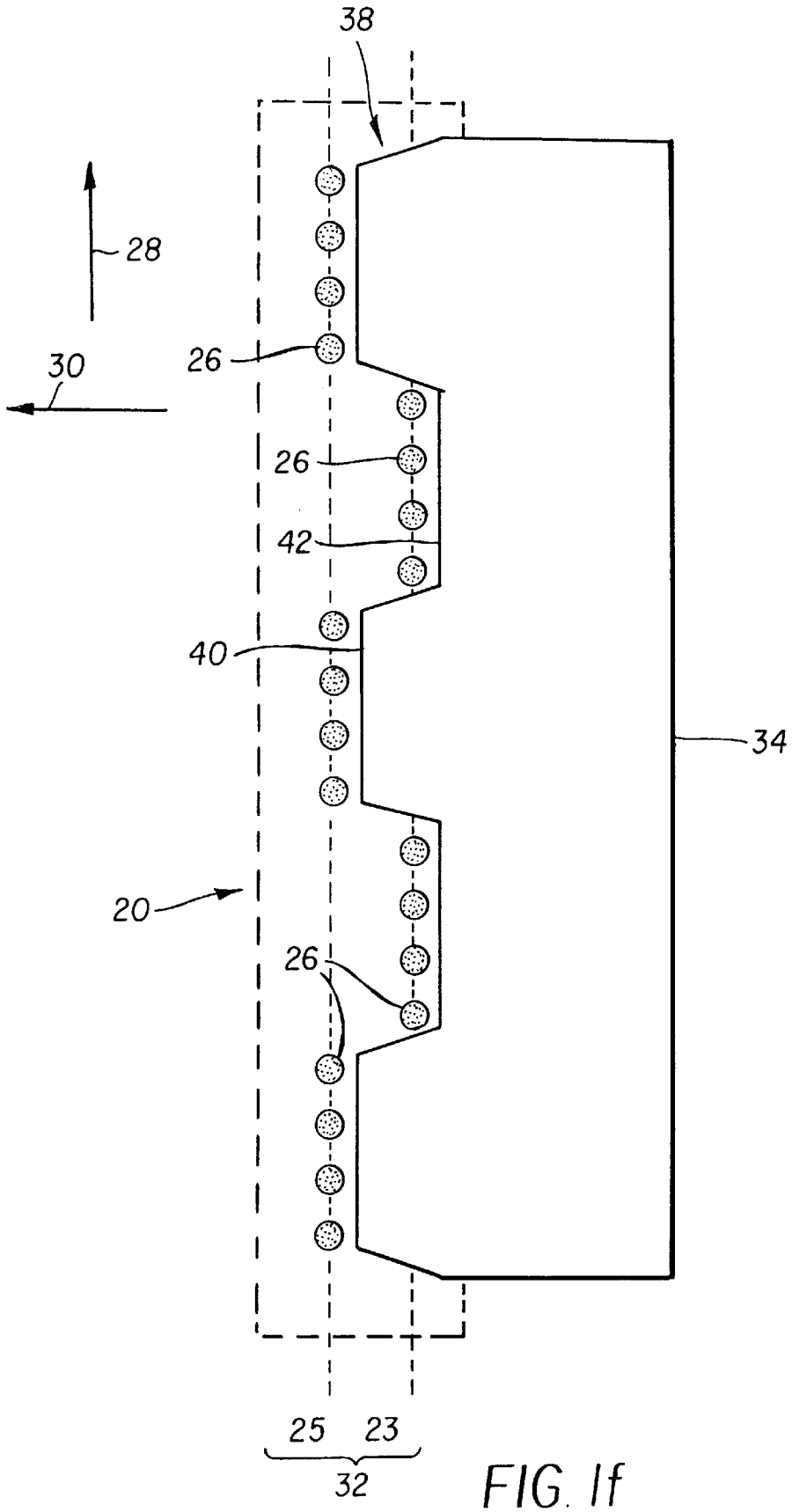
FIG. 1*f* is a schematic top view of an inkjet printhead showing the positioning relationship of an alternate two dimensional nozzle array and a serrated gutter.

It is to be understood that nozzles 26 need not be arranged strictly according to FIG. 1*a*. As such, it is specifically contemplated that nozzles 26 can be positioned on printhead surface 58 in a variety of configurations. For example, FIG. 1*f* shows a schematic top view of a printhead 20. As in FIG. 1*a* printhead 20 is illustrated schematically and not to scale for the sake of clarity. One of ordinary skill in the art will be able to readily determine the specific size and interconnections of the elements of each embodiment. Printhead 20 includes at least two rows 23, 25 of nozzles 26. Row 23 extends in a first direction 28, while row 25 extends in first direction 28 displaced from row 22 in a second direction 30. Typically, second direction 30 is substantially perpendicular to first direction 28. Row 25 is also offset in first direction 28 from row 23 with nozzles 26 of row 25 being positioned in between nozzles 26 of row 23. As in FIG. 1*a*, rows 23, 25 form a two dimensional nozzle array 32, however, the nozzles 26 are arranged in groups of four (4). It is recognized that the current arrangement may include more or less than four (4) nozzles 26 shown in the figure. A gutter 34 is positioned adjacent nozzle array 32 in second direction 30 and displaced from nozzle array 32 in a third direction 36 (shown in FIG. 1*b*) substantially orthogonal to directions 28 and 30. Note that gutter portions 40 and 42 are lengthened in first direction 28 as compared to that in FIG. 1*a* to capture drops from nozzle rows 23 and 25. As in FIGS. 1*d* and 1*e*, by appropriately timing the firing of nozzle rows 23 and 25, such that ink drops from the nozzle row 23 land on the same print line 62 on receiver 64 as ink drops from nozzle row 25, a row of printed drops 66 is formed.

Figure 1G:
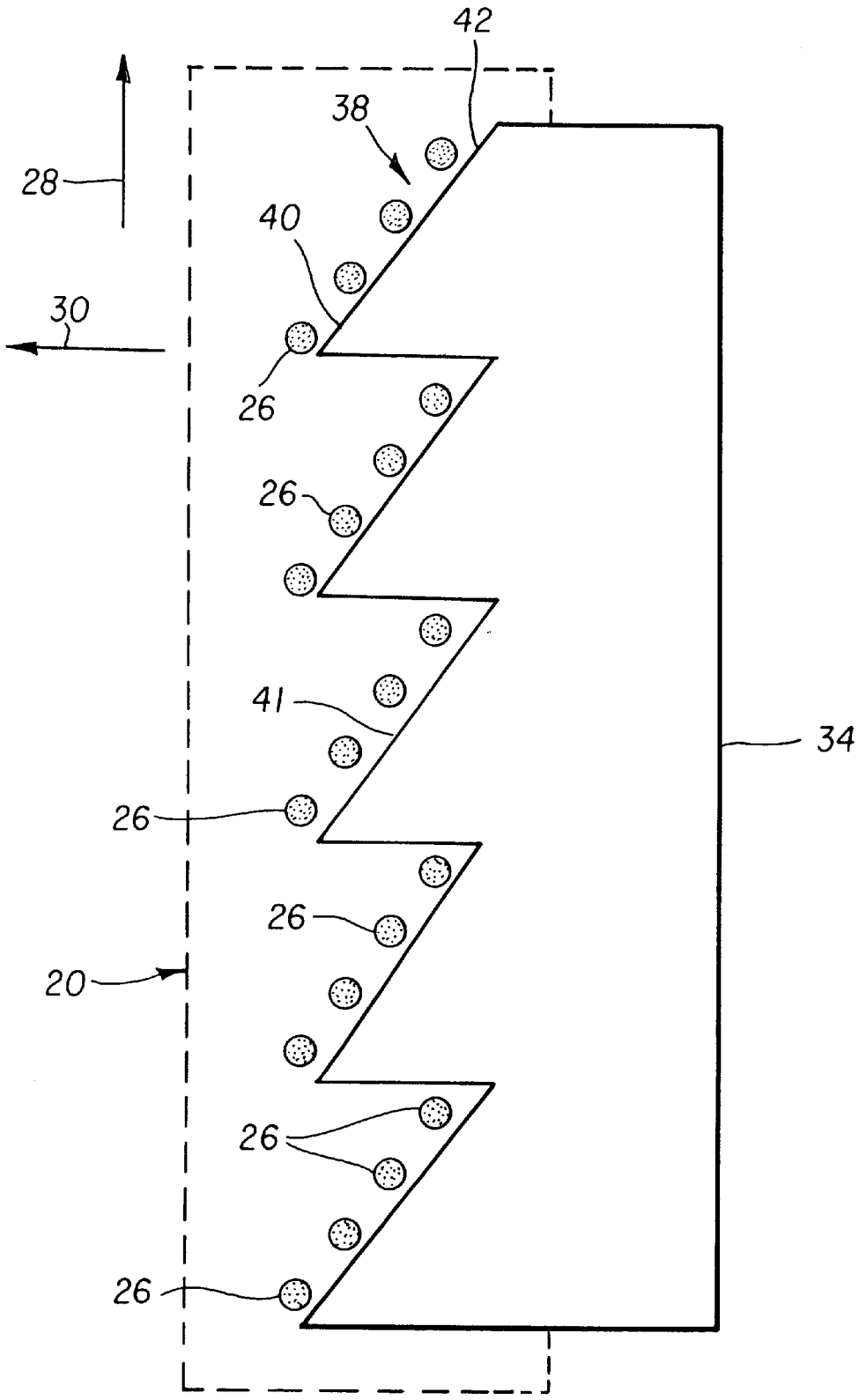
FIG. 1*g* is a schematic top view of an inkjet printhead showing the positioning relationship of yet another embodiment of a two dimensional nozzle array and a serrated gutter.

In yet another embodiment shown schematically in FIG. 1*g* the nozzles 26 are arranged in a saw tooth pattern. Note that in this embodiment there are four (4) nozzle rows. It is recognized that the current arrangement may include more or less than four (4) nozzle rows shown in FIG. 1*g*. Gutter 34 contains gutter portion 41 that is arranged to capture drops from nozzles 26. As in FIGS. 1*d*, 1*e*, and 1*f*, by appropriately timing (albeit different than that required in FIGS. 1*d*, 1*e*, or 1*f*) the ejection of ink drops from nozzle rows 22, 23, 24, and 25, ink drops from the nozzle row 23 land on the same print line 62 on receiver 64 as ink drops from nozzle row 25, a row of printed drops 66 being formed.

Figure 1H:
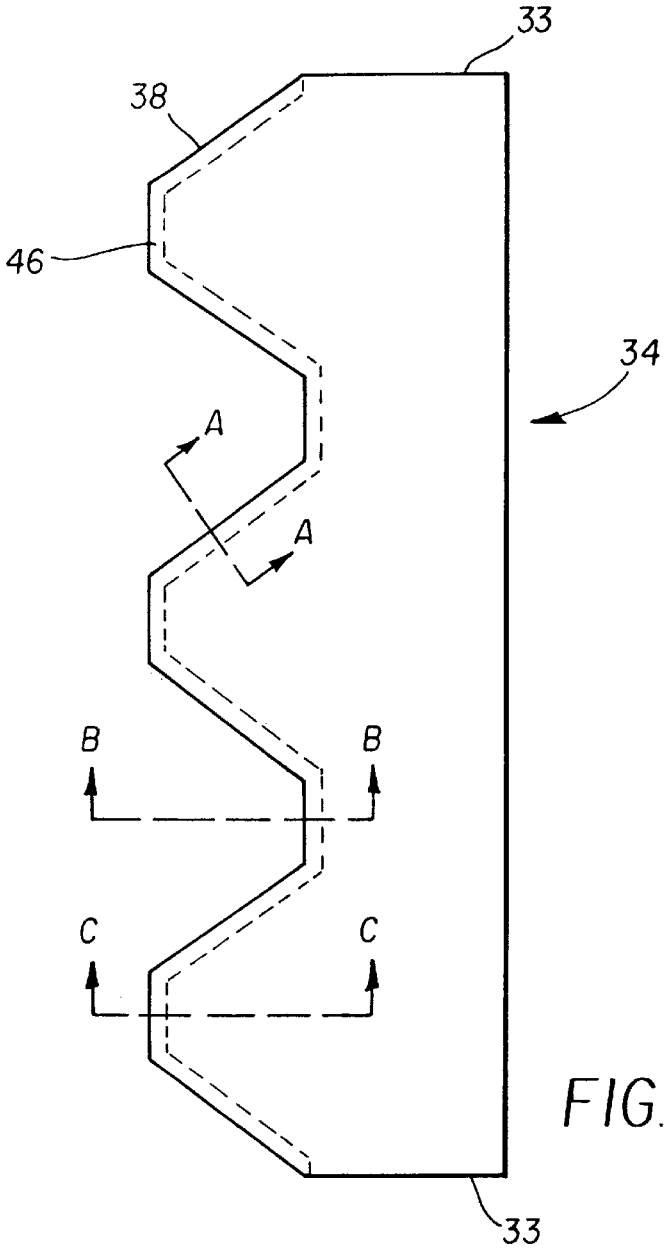
FIG. 1*h* is a schematic top view of he embodiment shown in FIG. 1*a* incorporating a device that reduces the affect of air forces acting on selected drops.
Figure 1I:
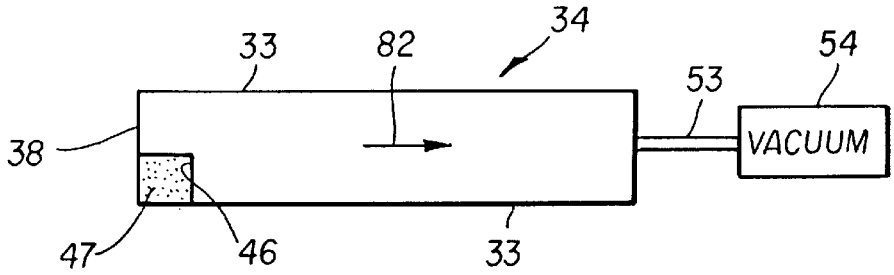
FIG. 1*i* is a schematic cross sectional view taken along lines AA, BB, and CC.

Referring to FIGS. 1*h* and 1*i*, gutter 34 described above, can help to create air forces that act on selected ink drops 74 (discussed below in reference to FIGS. 2*a* and 2*b*). This can create printed ink drop misalignment in first direction 28. In order to reduce the effects of air forces acting on selected drops 74, a semi-porous material 47 can be positioned through at least a portion of opening 46 of gutter 34. Semi-porous material 47 can be a wire mesh member, a sponge, porous foam, felt, a plastic or polymer screen mesh member, etc. For example, the wire mesh member disclosed in commonly assigned co-pending U.S. patent application Ser. No. 09/656,627, can be used. Semi-porous material 45 can be cemented in position using any adhesive, bonding agent, etc., known in the art. Alternatively, fabricating the serrated gutter such that opening 46 is just large enough to accommodate non-selected ink drops 76 will also help to reduce the effects of air forces acting on ink drops 74.

Figure 2A:
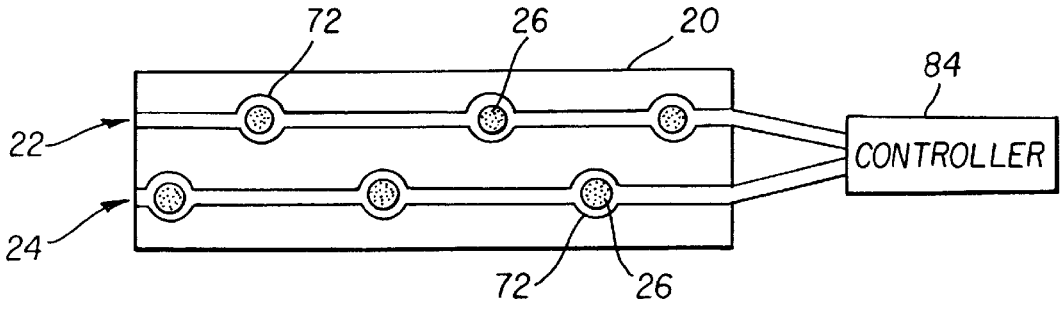
FIGS. 2*a* and 2*b* are schematic views of an apparatus incorporating the present invention.
Figure 2B:
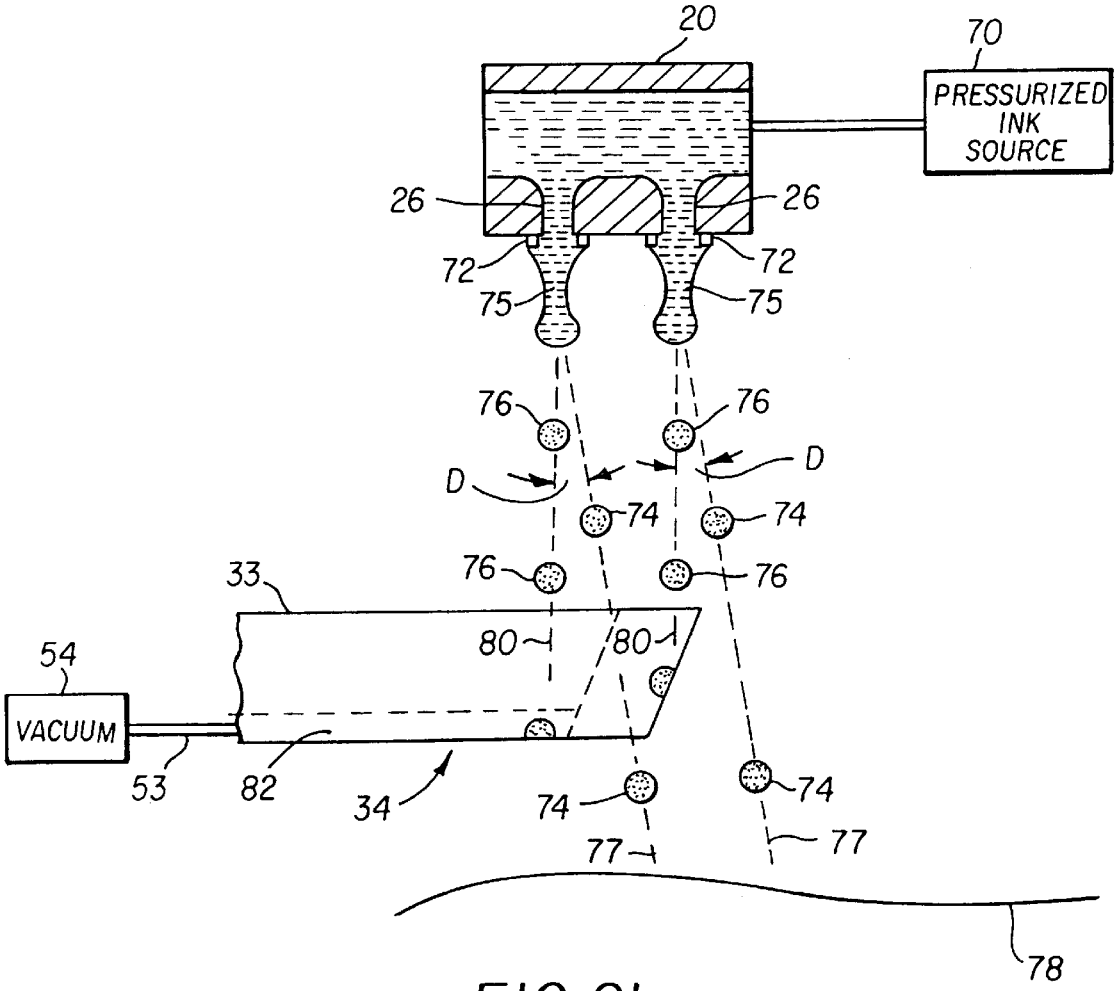

Referring to FIGS. 2*a* and 2*b*, an apparatus incorporating the present invention is shown. A printhead 20 includes a pressurized ink source 70 and a selection device 72. Printhead 20 is operable to form selected ink drops 74 and non-selected ink drops 76. Selection device 72 can include asymmetric heaters, for example, the asymmetric heaters disclosed in U.S. Pat. No. 6,079,821. Alternatively, selection device 72, can include electrostatic deflection plates, etc. Actuation of asymmetric heaters creates individual ink drops 74, 76 from a filament of working fluid 75 and deflects (through angle D) ink drops 74. Selected ink drops 74 travel along a selected ink drop path (e.g. a printed path) 77 ultimately striking recording medium 78, while non-selected ink drops 76 travel along a non-selected ink drop path (e.g. a non-printed path) 80 ultimately striking gutter 34. Non-selected ink drops 76 are recycled or disposed of through an ink removal channel 82 formed in gutter 34. Although, ink drop path divergence (shown generally at angle D), also commonly referred to as ink drop divergence angle, or ink drop discrimination, between selected ink drops 74 and non-selected ink drops 76 is small, the configuration of gutter 34 allows ink drops 76 from nozzles rows 22, 24 to be adequately captured. Alternatively, selected ink drops 74 can be captured by gutter 34 while non-selected ink drops are permitted to strike recording medium 78.

Ink drop size can be controlled by the frequency of activation of a selection device 72 by a controller 84. Controller 84 can be of any known type, for example, a programmable microprocessor incorporating a software program, a switch that selectively allows electrical current to pass through selection device 72. Additionally, by controlling the timing of activation of selection device 72, ink drop placement can also be controlled. This can also be accomplished using a controller of any known type, for example, a programmable microprocessor incorporating a software program.

The above described nozzle arrays can be fabricated using known MEMS techniques. In doing so, a precise alignment of the nozzles is readily achieved since as these fabrication methods typically involve lithography, well known in the art to render accurate nozzle patterns on a single substrate of a single printhead. Additionally, actuation timing can be accomplished using any known techniques and mechanisms, for example, microprocessor controllers, etc. Additionally, gutter 34 can also be formed using known MEMS techniques. Any suitable material can also be used for example, plastic, silicon, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A continuous ink jet printhead comprising:

a source of ink drops;

a first nozzle row;

a second nozzle row displaced in a first direction and a second direction relative to said first nozzle row;

a thermally activated selection device positioned relative to said first and said second nozzle rows, said selection device being configured to direct ink drops ejected from said source through said first nozzle row along a first selected ink drop path and a first non-selected ink drop path, said selection device also being configured to direct ink drops ejected from said source through said second nozzle row along a second selected ink drop path and a second non-selected ink drop path; and a gutter positioned adjacent said first and second non-selected ink drop paths, said gutter being shaped to collect ink drops traveling along said first and second non-selected ink drop paths.

2. The printhead according to claim 1, wherein said gutter includes a housing defining an ink removal channel, said housing having an edge, a second portion of said edge being displaced in said first direction and said second direction relative to a first portion of said edge such that displacement of said second edge portion corresponds to said displacement of said second nozzle row.

3. The printhead according to claim 2, wherein said edge is positioned adjacent said first and second non-selected ink drop paths such that said second edge portion collects ink drops traveling along said second non-selected ink drop path.

4. The printhead according to claim 2, wherein portions of said housing define an opening extending along said edge.

5. The printhead according to claim 4, said opening having an overall shape, said edge having an overall shape, wherein said overall shape of said opening corresponds to said overall shape of said edge.

6. The printhead according to claim 4, wherein a semi-porous material is positioned over said opening.

7. The printhead according to claim 4, wherein a semi-porous material is at least partially positioned within said opening.

8. The printhead according to claim 7, wherein said semi-porous material is a mesh member.

9. The printhead according to claim 1, each of said first and second nozzle rows having a plurality of nozzles, wherein at least one of the nozzles of the second nozzle row is positioned between two nozzles of the first row.

10. The printhead according to claim 1, wherein the thermally activated selection device is a heater.

11. The printhead according to claim 1, the first and second nozzle rows being located on a surface of said printhead, wherein the thermally activated selection device is positioned on said surface of said printhead.

12. A continuous ink jet printhead comprising:

a first nozzle row having at least one nozzle;

a second nozzle row displaced in a first direction and a second direction relative to said first nozzle row, said second nozzle row having at least one nozzle;

an asymmetric heater positioned about each nozzle of said first nozzle row and said second nozzle row; and a gutter disposed in a third direction relative to said first nozzle row, a first portion of said gutter positioned adjacent to said first nozzle row and a second portion of said gutter being positioned adjacent to said second nozzle row.

13. The printhead according to claim 12, wherein said first portion of said gutter and said second portion of said gutter define an edge, said gutter including an opening extending along said edge.

14. The printhead according to claim 13, said opening having an overall shape, said edge having an overall shape, wherein said overall shape of said opening corresponds to said overall shape of said edge.

15. The printhead according to claim 13, wherein a semi-porous material is positioned over said opening.

16. The printhead according to claim 13, wherein a semi-porous material is at least partially positioned within said opening.

17. The printhead according to claim 16, wherein said semi-porous material is a mesh member.

18. A continuous ink jet printhead comprising:

a nozzle plate, portions of said nozzle plate defining a first nozzle row and a second nozzle row displaced in a first direction and a second direction relative to said first nozzle row;

a selection device positioned on said nozzle plate relative to said first and said second nozzle rows, said selection device being configured to direct ink drops ejected through said first nozzle row along a first selected ink drop path and a first non-selected ink drop path, said selection device also being configured to direct ink drops ejected through said second nozzle row along a second selected ink drop path and a second non-selected ink drop path; and a gutter positioned adjacent said first and second non-selected ink drop paths, said gutter being shaped to collect ink drops traveling along said first and second non-selected ink drop paths.

19. The printhead according to claim 18, wherein said selection device is a thermally activated selection device.

20. The printhead according to claim 18, wherein said gutter includes a housing defining an ink removal channel, said housing having an edge, a second portion of said edge being displaced in said first direction and said second direction relative to a first portion of said edge such that displacement of said second edge portion corresponds to said displacement of said second nozzle row.

21. The printhead according to claim 20, portions of said housing defining an opening extending along said edge, wherein a semi-porous material is positioned about said opening.

* * * * *